US008240589B2

(12) United States Patent
Sommer et al.

(10) Patent No.: US 8,240,589 B2
(45) Date of Patent: Aug. 14, 2012

(54) METHOD FOR CRUSHING HOT CEMENT CLINKER

(75) Inventors: Erich Sommer, Köln (DE); Karl Schinke, Köln (DE)

(73) Assignee: KHD Humboldt Wedag GmbH, Cologne (DE)

( * ) Notice: Subject to any disclaimer, the term of this patent is extended or adjusted under 35 U.S.C. 154(b) by 1079 days.

(21) Appl. No.: 11/917,597

(22) PCT Filed: Jun. 10, 2006

(86) PCT No.: PCT/EP2006/005583
§ 371 (c)(1),
(2), (4) Date: Jun. 30, 2008

(87) PCT Pub. No.: WO2006/133870
PCT Pub. Date: Dec. 21, 2006

(65) Prior Publication Data

US 2008/0265073 A1 Oct. 30, 2008

(30) Foreign Application Priority Data

Jun. 16, 2005 (DE) ..... 10 2005 027 729

(51) Int. Cl.
*B02C 15/16* (2006.01)
*B02C 23/00* (2006.01)

(52) U.S. Cl. ..... 241/295; 241/187; 241/235

(58) Field of Classification Search ..... 241/187, 241/294, 295, 65, 235
See application file for complete search history.

(56) References Cited

U.S. PATENT DOCUMENTS

| | | | | | |
|---|---|---|---|---|---|
| 1,377,370 | A | * | 5/1921 | Stevenson | 241/295 |
| 1,748,828 | A | * | 2/1930 | Bowden | 241/295 |
| 1,893,030 | A | * | 1/1933 | Kingsley | 241/187 |
| 1,955,932 | A | * | 4/1934 | Preston | 241/294 |
| 2,043,328 | A | * | 6/1936 | Mosshart | 241/139 |
| 3,120,354 | A | * | 2/1964 | Kachelmann | 241/243 |
| 3,388,871 | A | * | 6/1968 | Gundlach | 241/295 |
| 3,412,946 | A | * | 11/1968 | Gabler et al. | 241/293 |
| 3,840,334 | A | * | 10/1974 | Chielens | 432/80 |
| 4,103,832 | A | * | 8/1978 | Braun et al. | 241/38 |
| 4,201,346 | A | * | 5/1980 | Wiemer | 241/66 |
| 4,252,282 | A | * | 2/1981 | Vermeulen et al. | 241/236 |
| 4,617,709 | A | * | 10/1986 | Gundlach | 241/293 |
| 4,765,550 | A | * | 8/1988 | Chen | 241/293 |
| 4,807,820 | A | * | 2/1989 | Gundlach | 241/294 |
| 4,848,683 | A | * | 7/1989 | Kawatsu | 241/294 |
| 5,199,657 | A | * | 4/1993 | Kastingschafer et al. | 241/235 |

(Continued)

FOREIGN PATENT DOCUMENTS

| | | |
|---|---|---|
| CH | 537755 | 7/1973 |

(Continued)

*Primary Examiner* — David J. Walczak
*Assistant Examiner* — Jennifer C Chiang
(74) *Attorney, Agent, or Firm* — Greer, Burns & Crain, Ltd.

(57) ABSTRACT

The aim of the invention is to provide a roll crusher for a grate cooler for cooling hot bulk material, in particular hot cement clinker, comprising several parallel crusher rolls. Said rolls are driven in opposite directions and comprise respective rotatably mounted axle tube rolls, onto each of which a large number of crusher rings that can be connected to the axle tube can be pushed. According to the invention, the crusher rings are configured in such a way that crusher elements project from the cylindrical outer face of the crusher rings, said elements being uniformly distributed both over the periphery and over the width of the crusher rings.

16 Claims, 2 Drawing Sheets

U.S. PATENT DOCUMENTS

| | | | | |
|---|---|---|---|---|
| 5,203,513 | A * | 4/1993 | Keller et al. | 241/30 |
| 5,269,477 | A | 12/1993 | Buchholtz et al. | |
| 5,524,839 | A * | 6/1996 | Schade et al. | 241/101.2 |
| 5,558,284 | A * | 9/1996 | Baumung et al. | 241/101.741 |
| 5,704,561 | A | 1/1998 | Ansén et al. | |
| 5,860,609 | A * | 1/1999 | Sommer et al. | 241/293 |
| 6,086,003 | A * | 7/2000 | Gunter et al. | 241/235 |
| 6,523,767 | B1 * | 2/2003 | Ramesohl | 241/293 |
| 7,021,577 | B2 * | 4/2006 | Papajewski et al. | 241/236 |
| 7,198,215 | B2 * | 4/2007 | Everson | 241/242 |
| 2003/0146318 | A1 * | 8/2003 | Condon | 241/236 |

FOREIGN PATENT DOCUMENTS

| | | |
|---|---|---|
| DE | 93384 | 8/1897 |
| DE | 19515568 | 10/1996 |
| EP | 0516952 | 12/1992 |
| EP | 0699479 | 3/1996 |
| EP | 1495812 | 1/2005 |

* cited by examiner

METHOD FOR CRUSHING HOT CEMENT CLINKER

BACKGROUND OF THE INVENTION

The invention relates to a roll crusher for crushing hot bulk material, such as, for example, cement clinker discharged from a baking kiln, having at least two crushing rolls which are arranged in parallel, are driven in opposite directions and have a rotatably mounted supporting tube, onto which in each case a multiplicity of crushing rings to be connected to the supporting tube in a rotationally fixed manner can be pushed, the outer surfaces of which crushing rings have crushing elements.

In a cement clinker production line, the blazing hot cement clinker burned from calcined raw cement meal in a rotary tubular kiln is ejected from the kiln discharge end onto a cooler, nowadays mostly onto the cooling grate of a grate cooler, is distributed on the latter and is moved by suitable conveying techniques in the longitudinal direction to the cooler discharge end, cooling air at the same time flowing essentially from bottom to top through the cooling grate and the hot bulk material layer transversely to the conveying direction. In this case, it has proved to be advantageous if the hot cement clinker, which tends to agglomerate, has as uniform a lump size as possible and uniform grain size distribution. It is therefore already known for a roll crusher having a plurality of crushing rolls arranged in parallel and rotatable in opposite directions to be arranged as an "intermediate crusher" in a grate cooler in the region of a cooling grate stage, which crushing rolls extend over the entire width of the grate cooler and have the task of comminuting in particular the large clinker lumps, which can then be cooled further after passing through the roll gaps in the adjoining grate cooler region, see, for example, brochure 7-330e of KHD Humboldt Wedag AG, dated October 1994, page 4. Clinker crushers in the form of such multiple roll crushers arranged at the clinker discharge end of a grate cooler in the material outlet shaft are also known.

In such roll crushers for crushing hot cement clinker, the roll surfaces are subjected to high mechanical and thermal stresses. EP 1 495 812 A1, for example, therefore discloses a multiple roll crusher which is arranged at the material discharge end of a cement clinker grate cooler and whose plurality of crushing rolls arranged parallel to one another and driven in opposite directions each have a rotatably mounted supporting tube construction, which constitutes a driven shaft, onto which in each case a plurality of crushing rings to be connected to the shaft in a rotationally fixed manner and having crushing elements on their outer surface can be pushed, such that, in the event of wear, the individual pushed-on crushing rings can be exchanged in a simple manner. In the known crushing rings, however, the spaced-apart crushing elements are distributed exclusively as axially parallel profiles and otherwise in their entirety in a nonuniform manner over the outer circumference of the crushing rings, as a result of which the roll gap between adjacent crushing rolls constantly narrows and then widens again during the crushing roll operation, a factor which, depending on the rotary angle position of the crushing rolls, results in nonuniform comminution of the cement clinker and a nonuniform grain size distribution of the discharge material leaving the multiple roll crusher, with the further consequence that clinker lumps that are not sufficiently broken up in the multiple roll crusher also cannot be sufficiently cooled. In addition, the varying grain band of the cement clinker has an adverse effect on the downstream grinding.

SUMMARY OF THE INVENTION

The object of the invention, for a grate cooler for cooling hot bulk material, in particular hot cement clinker, is to provide a multiple roll crusher of the type mentioned at the beginning which, with good material feeding behavior and long service life of the annular crushing tools, is suitable for comminuting the cement clinker fragments discharged from the rotary tubular kiln into fairly uniform lump sizes and for achieving a uniform grain size distribution in the broken-up material to be cooled, as a precondition for a high cooler efficiency and for more uniform downstream grinding.

Owing to the fact that interchangeable crushing rings serving as crushing tools are used in the roll crusher according to the invention assigned to a clinker cooler, from the cylindrical outer side of which crushing rings crushing elements project which are uniformly distributed or uniformly spaced apart over both the circumference and the width of the crushing ring bodies, the feed materials for the crushing rolls including the hot nests contained in the hot clinker layer are uniformly broken up by the crushing elements of the rotating crushing rolls, which results in a uniform grain size distribution in the crusher discharge material and thus in effective clinker cooling. In addition, the projecting crushing elements uniformly distributed over the cylindrical outer side of the crushing ring bodies perform the function of interchangeable aids for feeding the material to be crushed into the respective roll gap.

According to a further feature of the invention, the crushing elements projecting from the cylindrical outer side of the crushing ring bodies may have the form of studs, e.g., cylindrical studs, conical studs, polygonal studs, etc. Alternatively, however, the crushing elements may also have the form of webs lying parallel to the axis of the crushing ring.

In an especially advantageous manner, the material of the projecting crushing elements may be more wear-resistant than the material of the crushing ring body, which in particular comprises a metal casting carrying the crushing elements. Thus, for example, the material of the crushing elements may be carbide, for example sintered carbide. The complete crushing rings with the projecting crushing elements may be produced by composite casting or by welding the hard crushing elements onto the crushing ring bodies or by inserting the hard crushing elements into corresponding recesses, such as holes, grooves, etc., of the crushing ring bodies.

BRIEF DESCRIPTION OF THE DRAWINGS

The invention and its further features and advantages are explained in more detail with reference to the exemplary embodiments shown schematically in the figures, in which.

DETAILED DESCRIPTION OF THE PREFERRED EMBODIMENTS

Figure 1:
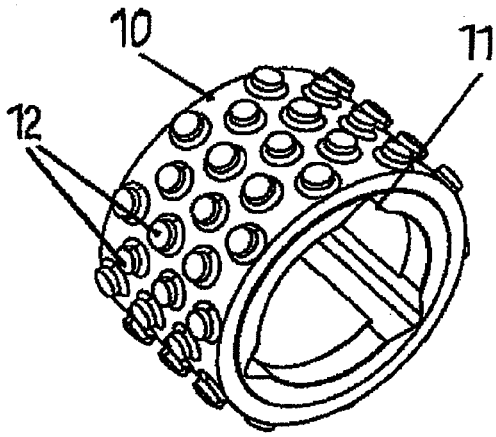
FIG. 1 shows the perspective view of a first embodiment of a crushing ring for the rolls of the roll crusher according to the invention.

In the roll crusher according to the invention, which is assigned to a cement clinker cooler, a plurality of crushing rolls, e.g., five or six crushing rolls, are arranged in parallel next to one another, said crushing rolls extending over the entire cooler width transversely to the cooler conveying direction and being driven in their plurality in opposite directions. In this case, the crushing rolls each have a rotatably mounted supporting tube 9, onto which in each case a plurality of crushing rings 10 to be connected to the supporting tube in a rotationally fixed manner can be pushed, the outer surface of which crushing rings has projecting crushing elements 12. That is to say that in each case a multiplicity of crushing rings 10 are pushed in an interchangeable manner onto the supporting tube 9 of each of the crushing rolls arranged in parallel next to one another, of which crushing rings the crushing ring 10 is shown in FIG. 1, which, like the other crushing rings too, is to be connected in a rotationally fixed manner to the supporting tube 9 via grooves 11 arranged on the inner side.

The outer side of the crushing ring 10 and of all the crushing rings pushed onto the associated supporting tube provided with rotary drive is cylindrical. As can clearly be seen from the perspective illustration in FIG. 1, crushing elements in the form of, for example, cylindrical studs 12 project from the cylindrical outer side of the crushing ring 10, said studs 12 being uniformly distributed over both the circumference and the width of the crushing ring 10. This uniform distribution or spacing of the multiplicity of crushing element studs 12 arranged in the manner of a grid applies to all the crushing rings 10 pushed in each case onto a supporting tube and then arranged directly next to one another, such that a pair of crushing rolls, arranged in parallel to one another and driven in opposite directions and equipped with the uniformly distributed zone of crushing element studs 12, has a good material feeding behavior, that is to say that it is also able to effectively break up hot nests contained in the interparticle bed of the hot cement clinker and produce a crushed material having a uniform grain size distribution, as a result of which the cooling efficiency during the cooling of the cement clinker is increased and the subsequent grinding of the cement clinker is made more uniform.

The crushing elements 12 may be arranged uniformly spaced apart, for example along surface lines of the crushing rings 10, and adjacent rows of crushing elements may also be staggered in such a way that the zone of crushing elements distributed uniformly over the circumference and the length of the crushing rolls is obtained.

Instead of having a cylindrical configuration, the crushing element studs 12 may also have, for example, a conical or also a polygonal configuration. The material of the projecting studs 12 is advantageously more wear-resistant than the material of the crushing ring body. Thus the studs 12 may be carbide pins which are firmly connected to the crushing ring body by composite casting or by welding onto the crushing ring body or by insertion into corresponding recesses of the crushing ring body.

Figure 3:
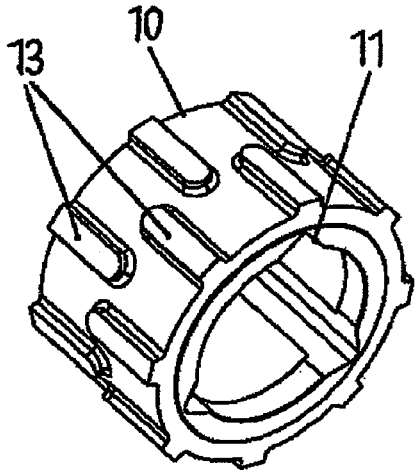
FIG. 3 shows the perspective view of a second embodiment of a crushing ring according to the invention.
Figure 2:
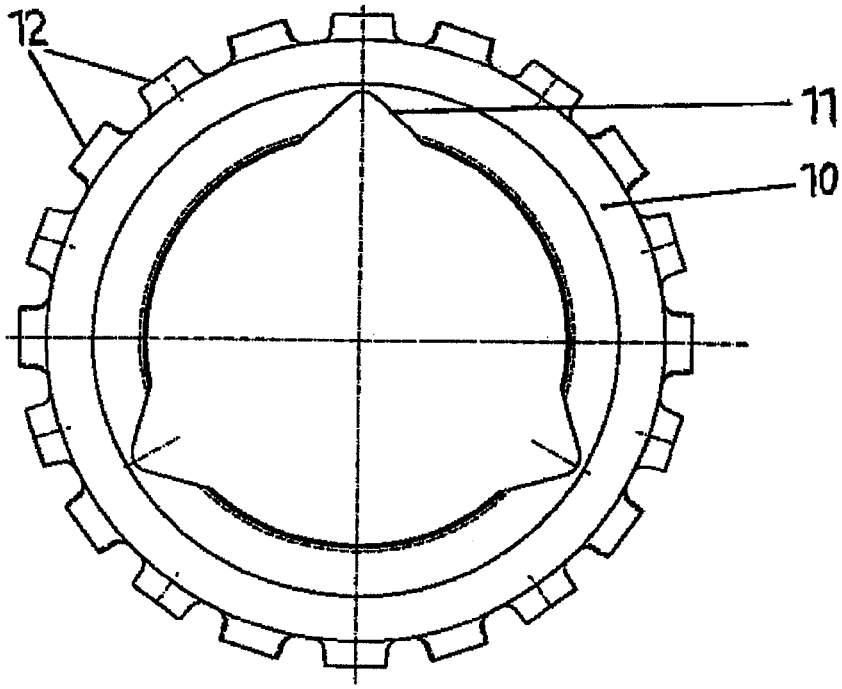
FIG. 2 shows an end view of the crushing ring of FIG. 1 in an enlarged illustration.
Figure 4:
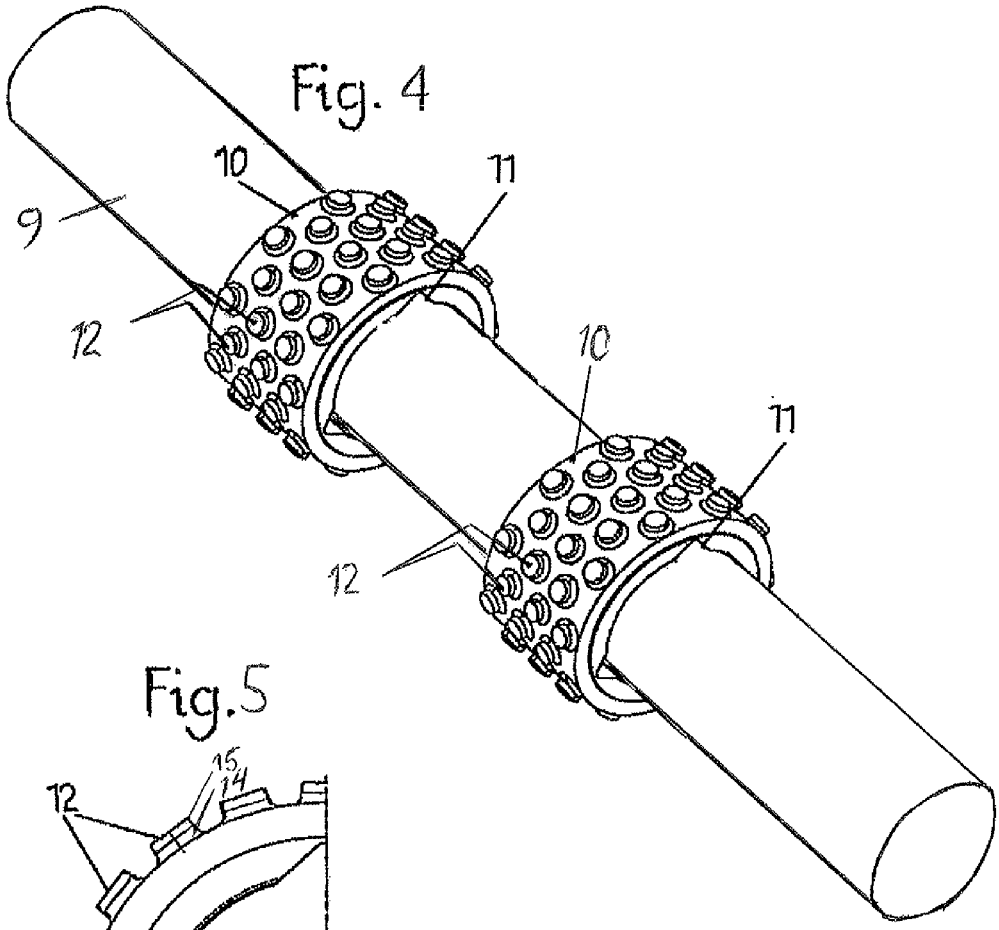
FIG. 4 shows a perspective view of a supporting tube carrying a plurality of crushing rings.

According to the exemplary embodiment in FIG. 3, the crushing elements projecting from the cylindrical outer side of the crushing rings 10 may also have the form of webs 13 which lie parallel to the axis of rotation of the crushing ring and which are again uniformly distributed over both the circumference and the width of all the crushing rings 10. Here, too, the rotationally fixed connection between the crushing rings 10 and the associated supporting tube by means of the axially parallel through-groove 11 or grooves ensures that the zone of uniformly distributed webs 13 projecting from the crushing rings 10 is obtained after all the crushing rings 10 pushed onto a supporting tube are lined up.

Figure 5:
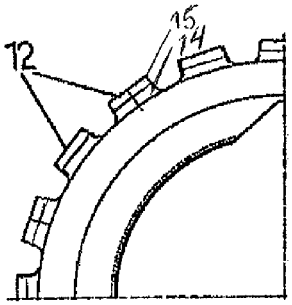
FIG. 5 shows a partial end view of the crushing ring of FIG. 1 in an alternate embodiment.

As shown in FIG. 5, the crushing elements 12, 13 projecting from the crushing rings 10 may in each case also have two parts, that is to say they may comprise a radially inner part 14 and a radially outer part 15 of more wear-resistant material, it also being possible for the radially outer part to have the form of a cap.

Numerical examples with respect to FIG. 1: range of the diameter of the studs 12 approximately 15 to 50 mm, their distances apart approximately 30 to 70 mm and their height approximately 20 mm. With respect to FIG. 3: range of the width of the webs 13 approximately 15 to 50 mm, range of the length of the webs 13 approximately 50 to 200 mm and their height approximately 20 mm.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A method for crushing agglomerated hot bulk material comprising the steps:

providing at least two parallel crushing rolls in the form of supporting tubes, sliding a plurality of individually slidable and interchangeable crushing rings on each supporting tube, and rotationally fixing each of said rings on said tubes, each of said crushing rings including crushing elements provided at its outer surface, the outer surfaces of each of the crushing rings being cylindrical, and the crushing elements projecting from the cylindrical outer surface of the crushing rings and being uniformly distributed over both a circumference and a width of the crushing rings, and rotating said at least two parallel crushing rolls in opposite directions to draw the hot bulk material into a nip formed between said at least two parallel crushing rolls and breaking up and crushing the agglomerated hot bulk material by the crushing elements carried on the at least two parallel crushing rolls so as to achieve broken up hot bulk material and a uniform grain size distribution in the broken up hot bulk material.

2. The method as claimed in claim 1, wherein the crushing elements have the form of studs.

3. The method as claimed in claim 1, wherein the crushing elements have the form of webs lying parallel to an axis of rotation of the crushing ring.

4. The method as claimed in claim 1, wherein a material of the projecting crushing elements is more wear-resistant than a material of a body of the crushing ring.

5. The method as claimed in claim 4, wherein the crushing ring bodies with the projecting crushing elements are produced by composite casting.

6. The method as claimed in claim 4, wherein the crushing ring bodies with the projecting crushing elements are produced by welding the crushing elements onto the crushing ring bodies.

7. The method as claim in claim 4, wherein the crushing ring bodies with the projecting crushing elements are produced by inserting the crushing elements into corresponding recesses of the crushing ring bodies.

8. The method as claimed in claim 1, wherein the crushing elements are each composed of two parts, a radially inner part and a radially outer part of more wear-resistant material.

9. A method for crushing agglomerated hot cement clinker discharged from a rotary tubular kiln comprising the steps:

providing at least two parallel crushing rolls in the form of supporting tubes, sliding a plurality of individually slidable and interchangeable crushing rings on each supporting tube, and rotationally fixing each of said rings on said tubes, each of said crushing rings including crushing elements provided at its outer surface, the outer surfaces of each of the crushing rings being cylindrical, and the crushing elements projecting from the cylindrical outer surface of the crushing rings and being uniformly distributed over both a circumference and a width of the crushing rings, and rotating said at least two parallel crushing rolls in opposite directions to adjacent crushing rolls to draw the agglomerated hot cement clinker into a nip formed between adjacent ones of said at least two parallel crushing rolls and breaking up and crushing the agglomerated hot cement clinker by the crushing elements carried on the at least two parallel crushing rolls so as to achieve broken up hot cement clinker and a uniform grain size distribution in the broken up hot cement clinker.

10. The method as claimed in claim 9, wherein the crushing elements are in the form of studs.

11. The method as claimed in claim 9, wherein the crushing elements have the form of webs lying parallel to an axis of rotation of the crushing ring.

12. The method as claimed in claim 9, wherein the projecting crushing elements are formed of a material that is more wear-resistant than a material which forms a body of the crushing ring.

13. The method as claimed in claim 12, wherein the crushing ring bodies with the projecting crushing elements are produced by composite casting.

14. The method as claimed in claim 12, wherein the crushing ring bodies with the projecting crushing elements are produced by welding the crushing elements onto the crushing ring bodies.

15. The method as claimed in claim 12, wherein the crushing ring bodies with the projecting crushing elements are produced by inserting the crushing elements into corresponding recesses of the crushing ring bodies.

16. The method as claimed in claim 9, wherein the crushing elements are each composed of two parts, a radially inner part and a radially outer part of more wear-resistant material than the radially inner part.

* * * * *